United States Patent [19]

Terrell

[11] 4,395,058

[45] Jul. 26, 1983

[54] CLIP FOR SUSPENSION FILING

[75] Inventor: Christopher E. Terrell, London, England

[73] Assignee: W. F. Industries, Inc., Wheeling, Ill.

[21] Appl. No.: 244,709

[22] Filed: Mar. 17, 1981

Related U.S. Application Data

[63] Continuation-in-part of Ser. No. 955,655, Oct. 30, 1978, abandoned.

[30] Foreign Application Priority Data

Nov. 3, 1977 [GB] United Kingdom ..... 45845/77

[51] Int. Cl.[3] ..... B42D 17/00; B42F 15/00

[52] U.S. Cl. ..... 281/46; 24/255 R; 281/15 A; 312/184

[58] Field of Search ..... 24/255 R; 281/15 A, 281/15 R, 46; 312/184

[56] References Cited

U.S. PATENT DOCUMENTS

| | | | |
|---|---|---|---|
| 429,301 | 6/1890 | Brown | 281/15 A |
| 637,641 | 11/1899 | Moore | 281/46 |
| 1,020,995 | 3/1912 | Leeds | 281/46 |
| 1,793,520 | 2/1931 | Siptrott | 281/46 X |
| 2,378,747 | 6/1945 | Berman et al. | 24/255 R X |
| 2,981,259 | 4/1961 | Smith | 281/46 |
| 3,238,947 | 3/1966 | Churnick | 312/184 |
| 3,255,758 | 6/1966 | Gauche | 312/184 |
| 3,298,374 | 1/1967 | Grundell | 312/184 X |
| 3,462,809 | 8/1969 | Froehlich, Jr. | 24/255 R |
| 3,596,928 | 8/1971 | Edmonds | 281/46 |
| 3,826,582 | 7/1974 | Podosek | 281/15 A X |

FOREIGN PATENT DOCUMENTS

| | | | |
|---|---|---|---|
| 79713 | 2/1971 | German Democratic Rep. | 24/255 R |

*Primary Examiner*—Paul A. Bell

*Attorney, Agent, or Firm*—Brady, O'Boyle & Gates

[57] ABSTRACT

A clip is provided for use in the suspension filing of magazines, journals and like articles having sheets or pages held together in a spinal portion. The clip comprises a bifurcate part having two fingers engageable respectively inside and outside the spinal portion of a magazine to grip the spinal portion between them, and a hook part engageable over a side rail of a suspension filing system. By inserting a clip at each end of the spinal portion of a magazine and engaging the hooks over the two parallel rails of a suspension filing system, the magazine can be suspended with its spinal portion performing the function of the normal cross-bar in such a system.

3 Claims, 5 Drawing Figures

CLIP FOR SUSPENSION FILING

CROSS-REFERENCE TO RELATED APPLICATION

This application is a continuation-in-part of application Ser. No. 955,655, filed Oct. 30, 1978, now abandoned.

BACKGROUND OF THE INVENTION

This invention is concerned with improvements in or relating to filing means, particularly for magazines, journals and like articles having sheets or pages held together in a spinal portion. Such articles will all hereinafter be referred to as "magazines".

Various forms of equipment are available which can be used for filing magazines. For example, it is known to secure magazines in a binder by passing resilient metal wires inside spinal folds in the magazines and engaging the ends of the wires in holes in racks secured inside the spinal part of the binder. It is also possible to file magazines in the suspended folders of a conventional suspension filing system.

It is an object of the present invention to provide comparatively simple and inexpensive means for filing magazines.

The invention provides a clip comprising a bifurcate part having two fingers engageable respectively inside and outside the spinal portion of a magazine to grip said spinal portion between them, and a hook part engageable over a side rail of a suspension filing system. Thus, by inserting a clip at each end of the spinal portion of a magazine and engaging the hooks over the two parallel rails of a suspension filing system, the magazine can be suspended with its spinal portion performing the function of the normal cross-bar in such a system.

The bifurcate part may be made wholly or partly of resiliently deformable material, whereby said fingers can resiliently grip said spinal portion. Alternatively or additionally, at least one of the fingers may carry resiliently deformable means for engaging the magazine.

The hook part preferably comprises an arm extending from the bifurcate part in the opposite direction to said fingers and a projection on said arm spaced away from the bifurcate part.

Preferably, at least one of said fingers has a depth substantially greater than its thickness, and can be disposed inside the spinal portion of a magazine to resist turning of the clip on the magazine.

Preferably, at least one of said fingers has projections on opposite sides of an edge thereof facing the other finger, which projections are engageable with the outside of the spinal portion of a magazine to resist turning of the clip on the magazine and displacement of the clip from the magazine.

Preferably, the clip is made in one piece from a resilient plastics material. In that case, it is preferred that one of said fingers is provided with one or more resiliently deflectable members projecting therefrom so as to be engageable with the inside of the spinal portion of a magazine. Alternatively, the hook part and one of the fingers (preferably the finger which in use will be outside the spinal portion) are made in one piece from plastics material and the other finger comprises a resilient metal member (e.g. made of wire) carried by the plastics material.

DETAILED DESCRIPTION

Figure 1:
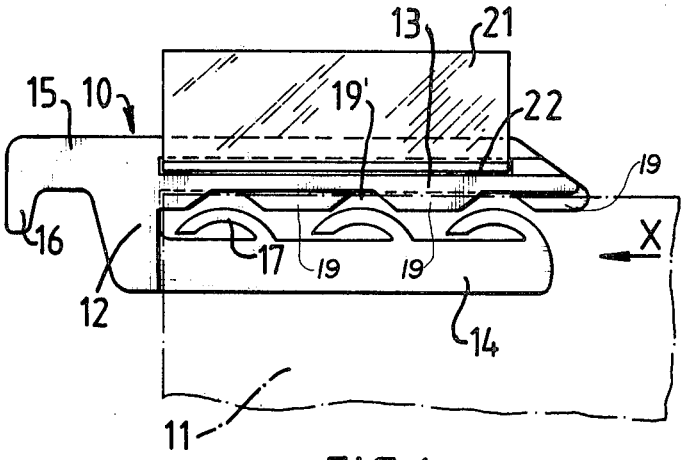
FIG. 1 is a side view of one embodiment of the clip.
Figure 2:
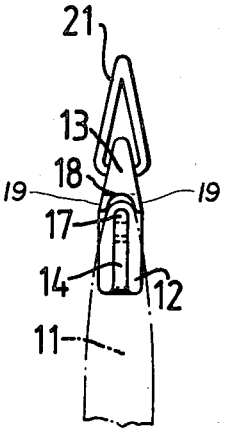
FIG. 2 is an end view of the clip of FIG. 1 in the direction of the arrow X.

Referring first to FIGS. 1 and 2, the clip 10 is for use with a magazine 11, one end of the spinal portion of which is shown in broken lines. The clip 10, which is molded in one piece from resilient plastics material, is a generally flat member having a length and depth (see FIG. 1) both substantially greater than its thickness (see FIG. 2). It comprises a bifurcate part 12 having two fingers 13 and 14, and a hook part constituted by an arm 15 extending from the bifurcate part in the opposite direction to the fingers with a projection 16 on the arm spaced away from bifurcate part. Thus, the hook part comprises an open-sided recess bonded on three sides by the projection 16, the arm 15 and an abutment portion at the root of the bifurcate part 12. The facing edges of the projection 16 and the abutment portion diverge as they extend. The clip is slid on to an end of the spinal portion of the magazine into the position shown, the fingers 13 and 14 lying respectively outside and inside the spinal portion. The finger 14 is provided with integral resiliently deflectable members in the form of arcuate prongs 17. Each prong 17 has a free end and an end joined to the finger. The joined ends of the prongs are nearer to the free end of the finger than the free end of the prongs are (on the right in FIG. 1) so as to facilitate sliding of the clip into the magazine. Convex portions of the prongs 17 bear against the inside of said spinal portion and urge the outside thereof against the finger 13. The finger 13 has a longitudinal recess 18 which receives and locates the outside of said spinal portion under the pressure of the members 17.

The finger 13 has a plurality of longitudinally spaced, depending projections 19 formed on opposite side edges of the longitudinally extending recess 18. The projections 19 are alternately arranged along the opposite side edges of the recess, and the space between successive projections 19 forms a notch 19' aligned with the convex portion of a respective prong 17. By this construction and arrangement, the prongs 17 bias the inside spiral portion of the magazine outwardly to thereby press the outside spinal portion of the magazine into the notches 19', and the alternately arranged projections 19 engage opposite faces of the magazine adjacent the spinal portion thereof to enhance the gripping action of the clip by resisting end-wise as well as rotational displacement of the clip. Resistance to rotational displacement is assisted by the finger 14 being substantially deeper than it is thick. An index holder 21 of resilient transparent plastics sheet can be slid on to the clip so that edges of the holder engage in grooves 22 in the finger 13.

Figure 5:
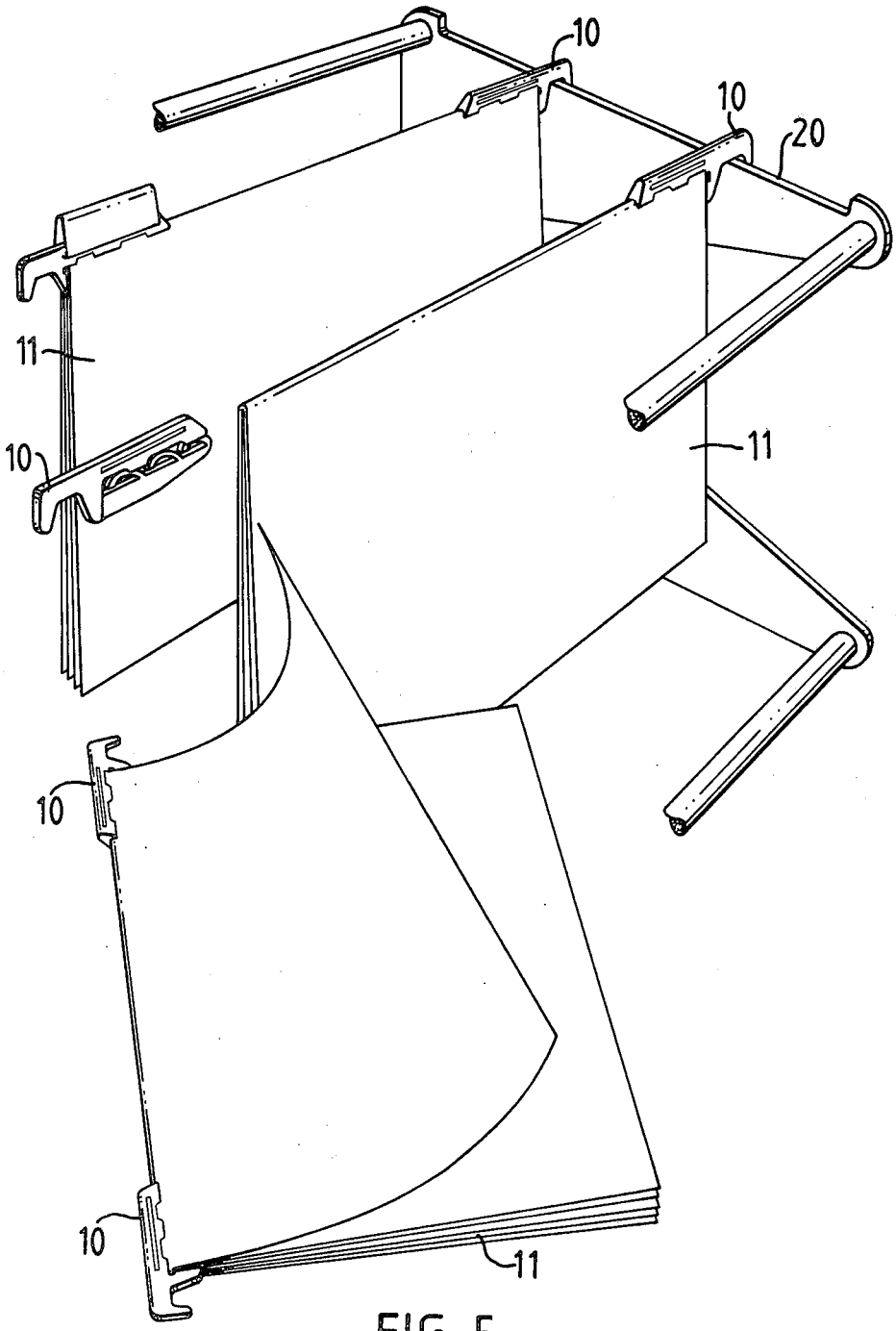
FIG. 5 is an isometric view showing the clip of FIG. 1 in use.

In use (as shown in FIG. 5), a clip 10 is slid on to each end of the spinal portion of a magazine 11. The extent of penetration of each clip is limited by engagement with the magazine of the portion of the bifurcated part at the juncture of the fingers. The hook parts of the clips are then engaged over two parallel rails 20 (only one of which is shown in FIG. 5 for clarity of illustration) of a suspension filing rack, so that the magazine hangs down. The fingers 13 and 14 are of course of sufficient length to prevent downward swinging of the clips about the rails and displacement from the magazine under the weight thereof. A number of magazines, each with two clips, can therefore be suspended in desired order in the rack. When it is desired to remove a magazine, it is simply lifted, together with its two clips, from the rack. The clips remain in place on the magazine and provide little or no obstruction to reading, even reading the central pages. Therefore, the magazine can be returned to the desired place in the rack simply by engaging the hook parts of the clips over the rails.

Figure 3:
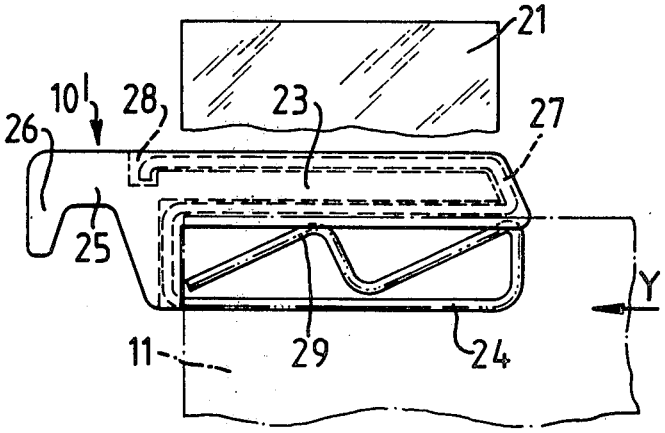
FIG. 3 is a side view of another embodiment of the clip.
Figure 4:
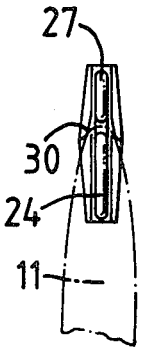
FIG. 4 is an end view of the clip of FIG. 3 in the direction of the arrow Y.

Referring to FIGS. 3 and 4, the clip 10' is generally flat having a length and depth both substantially greater than its width. It comprises a bifurcate part comprising fingers 23 and 24 and a hook part constituted by an arm 25 extending from the bifurcate part with a projection 26 spaced away from the bifurcate part. The base of the bifurcate part, the finger 23, the arm 25 and the projection 26 are all molded in one piece from plastics material. The finger 24 is made of spring wire and is secured in place by a portion 27 of the wire which engages in an open groove running from the finger 24 through the base of the bifurcate part and round the periphery of the finger 23, the end of said portion 27 being turned down into a locating recess 28 at the end of the open groove. The wire in the finger 24 is bent back on itself and terminates in a free end, the bent-back part being shaped to provide projecting parts 29 which resiliently press the spinal portion of the magazine into a groove 30 in the finger 23 to resist rotational and endways displacement of the clip on the magazine. Rotational displacement is also resisted by engagement with the pages of the magazine of the finger 24, of which the overall depth is substantially greater than the thickness. The manner of use of the clip is the same as hereinbefore described with reference to the clip of FIGS. 1 and 2.

It will be seen from FIGS. 1, 2, 3 and 4 that in both embodiments of clip, the bifurcate portion provides an inclined shoulder which together with an inclined face on the projection 16 or 26 defines a tapered recess facilitating location of the clip on a supporting rail.

The stand hereinbefore mentioned with reference to FIG. 5 may conveniently comprises two side panels (for instance, of suitably shaped rigid plastics sheet) connected by cross-bars. Different sizes of magazine can be filed by using the cross-bars of suitable length.

The terms and expressions which have been employed herein are used as terms of description and not of limitation, and there is no intention, in the use of such terms and expressions, of exluding any equivalents of the features shown and described or portions thereof but it is recognized that various modifications are possible within the scope of the invention claimed.

I claim:

1. A clip for removably engaging the side rail of a suspension filing system for the filing of magazines, journals and the like, comprising a generally flat, one piece, resilient plastic member having a bifurcate part and a hook part, said member having a length and depth both substantially greater than its thickness, the bifurcate part having two fingers extending in a direction lengthwise of said member away from the hook part and being displaced from one another in a direction depthwise of said member, said fingers being engageable respectively inside and outside the spinal portion of a magazine for gripping said spinal portion therebetween, one of said fingers having at least one resiliently deflectable arcuate prong having a free end and a convex portion projecting therefrom for engaging the inside spinal portion of a magazine; the other of said fingers having at least two longitudinally spaced, alternately arranged projections on opposite sides of an edge of said other finger facing said one finger, the space between successive projections forming a notch aligned with the convex portion of said prong, whereby the prongs bias the inside spinal portion of the magazine to thereby press the outside spinal portion of the magazine into the notch while the alternately arranged projections engage opposite faces of the magazine adjacent the spinal portion thereof to enhance the gripping action of the clip by resisting end-wise as well as rotational displacement of the clip; said hook part having an open-sided recess opening in a depthwise direction, whereby when two clips are engaged at opposite ends of the spinal portion of a magazine, the hook part on each clip is engageable over a respective side rail of the suspension filing system with said rail received in the recess and said fingers being disposed horizontally, whereby the magazine and associated clips are removably suspended from the two side rails of the suspension filing system.

2. A clip according to claim 1, wherein the free end of the prong is disposed at the end of the prong farthest from the free ends of the fingers.

3. A clip according to claim 1, wherein a longitudinally extending recess is provided in said other of said fingers facing said one finger, said alternately arranged projections depending from the opposite sides of said recess.

* * * * *